US005198801A

United States Patent [19]

Duggan et al.

[11] Patent Number: 5,198,801

[45] Date of Patent: Mar. 30, 1993

[54] LOW AMPERAGE DUEL SENSING FIRE DETECTOR

[75] Inventors: Jack Duggan, Markham; Michael J. Heslop, Rexdale, both of Canada

[73] Assignee: Fire Detection Devices Ltd., Markham, Canada

[21] Appl. No.: 466,864

[22] Filed: Jan. 18, 1990

[51] Int. Cl.[5] ..... G08B 17/06

[52] U.S. Cl. ..... 340/589; 340/521; 340/529; 340/584; 340/595

[58] Field of Search ..... 340/589, 595, 584, 521, 340/530, 529, 587

[56] References Cited

U.S. PATENT DOCUMENTS

| | | | |
|---|---|---|---|
| 3,255,441 | 6/1966 | Goodwin et al. | 340/589 |
| 3,962,696 | 6/1976 | Smith et al. | 340/530 |
| 4,240,077 | 12/1980 | Hughes et al. | 340/589 |
| 4,381,503 | 4/1983 | Kobayashi | 340/589 |
| 4,709,229 | 11/1987 | Otsuka | 340/529 |

*Primary Examiner*—Glen R. Swann, III

[57] ABSTRACT

A resettable fire detection device comprises in combination a rate of temperature rise sensor, an electronic fixed temperature sensor, and electronic circuitry connected to both circuits for producing an alarm signal if either sensor is activated and for maintaining the alarm signal once the device has been activated. This resettable fire detection device has many uses: specifically, it can be used as a replacement device for a smoke detector device commonly used on ships. In this case, the device draws a very low amperage for use on a parallel circuit common wih smoke detectors. In addition, a time delay circuit can be associated with each of the sensors to avoid false alarms and to accommodate certain environmental conditions. The resettable nature of both the fixed temperature and rate of rise temperatue sensor allows full testing of each device while allowing a remote reset signal to be used to reset the device. In a preferred form, the rate of temperature rise sensor is a mechanical arrangement.

5 Claims, 3 Drawing Sheets

LOW AMPERAGE DUEL SENSING FIRE DETECTOR

FIELD OF THE INVENTION

The present invention relates to fire detecting systems and, in particular, to a fire detection device suitable for sensing of a given rate of temperature rise and a fixed temperature detector.

BACKGROUND OF THE INVENTION

Fixed point temperature sensing in combination with a rate of rise detector is already known, as exemplified in U.S. Pat. No. 4,651,140 which issued Mar. 17, 1987. According to this structure, a fusable metal having a specified melting point is used to maintain a mechanical arrangement and upon reaching of the particular temperature, the mechanical arrangement is released, causing the device to operate. Once the fixed point temperature sensing device has been actuated, the entire detector must be replaced. Therefore, any testing of the device must be done in association with the rate of rise sensing mechanism which is resettable. Electronic fixed point temperature sensing devices are known and because of their electronic nature, can be tested and reset.

Smoke detectors have often proven popular and operate on a different principle, namely, the detection of smoke in the air which is an indication that a fire is present. In a complete monitoring system having a number of smoke detectors such as that manufactured and sold by Cerberus Pyrotronics, the system operates on a parallel circuit where each device draws a very low amperage and an alarm signal is indicated by a substantial drop in voltage between the two parallel lines. Although smoke detectors are desirable in certain applications, it would also be desirable to be able to substitute in an existing system a smoke detector device with a fixed point temperature detecting device in combination with a rate of rise sensing mechanism, which in certain applications is more advantageous. This requires the detecting device to be compatible with the operating characteristics of a smoke detecting system and the smoke detecting devices used therein.

SUMMARY OF THE INVENTION

A resettable fire detection device, according to the present invention, comprises in combination a rate of temperature rise sensor, an electronic temperature sensor, and electronic circuitry connected to both sensors for producing an alarm signal if either sensor is activated and which maintains the alarm signal once activated until a reset signal is received. The electronic temperature sensor cooperates with the electronic circuitry for defining a fixed temperature actuation point.

According to a preferred aspect of the invention, the electronic circuitry includes a time delay arrangement for delaying an alarm signal a fixed length of time prior to actuating the alarm signal to accommodate what may be very short environmental conditions which otherwise would cause actuation of the alarm.

According to yet a further aspect of the invention, the device operates at very low amperage for use on a parallel circuit and draws less than 200 micro-Amps.

The invention is also directed to a resettable fire detector and a low amperage smoke detecting system where the detectors work in combination with the system. The system is designed to have a plurality of low amperage draw smoke detectors. A number of these smoke detectors are replaced with resettable fire detector devices. Each of the resettable fire detector devices comprises a resettable electronic fixed point temperature sensor and a resettable rate of temperature rise detector sensor which cooperate with electronic circuitry for powering and processing the output of the sensors. The resettable fire detector devices are also designed to be of low amperage, fully compatible with the system whereby the fire detector devices can merely replace smoke detectors in the overall system.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
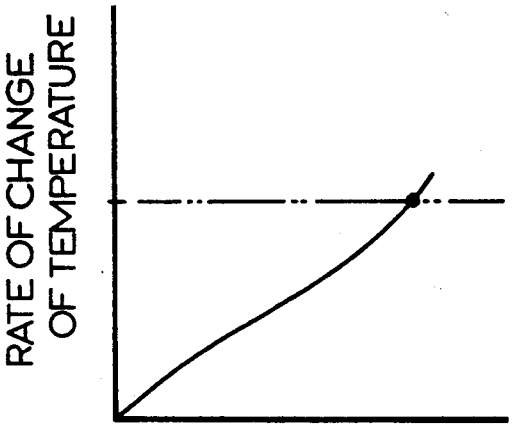
FIG. 1 and 2 are graphs illustrating operation of the resettable fire detection device.
Figure 2:
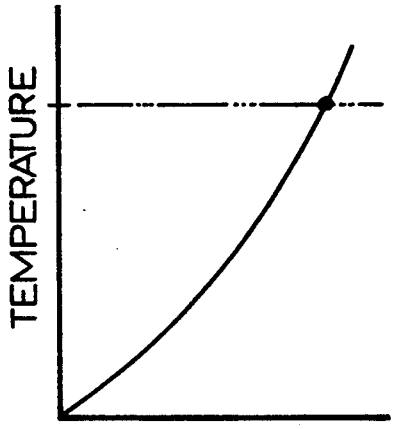
Figure 3:
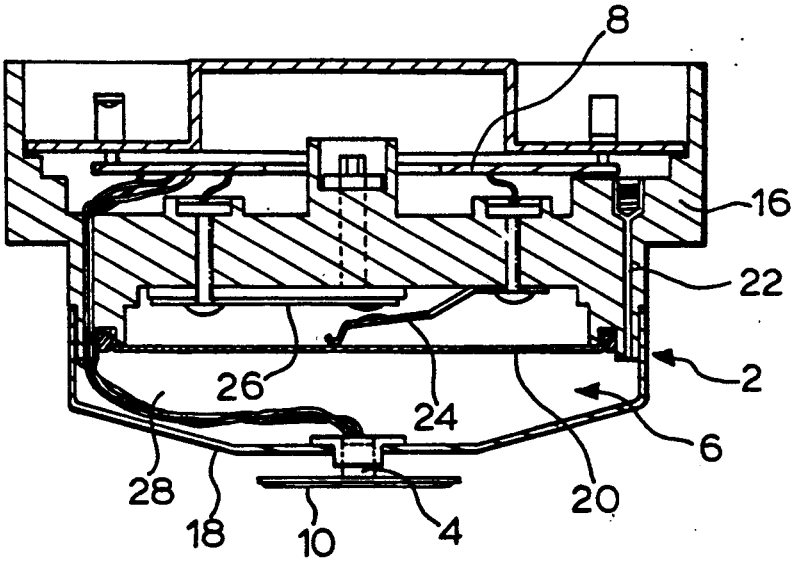
FIG. 3 is a sectional view through the device.

The resettable fire detection device, generally shown as 2 in FIG. 3, has a temperature sensor 4 comprising an integrated circuit having a linear voltage output with increasing temperature, whereby the output of the sensor provides an accurate indication of the temperature. The temperature sensor 4 cooperates with the electronic circuitry 8 to define a fixed temperature actuation point. The rate of temperature rise sensor 6 is a mechanical arrangement and is generally described in U.S. Pat. No. 4,615,140 incorporated herein by reference. Electronic circuitry 8 is connected to the output of both the rate of temperature rise sensor 6 and the temperature sensor 4 for processing of the output of the sensors and creating an alarm signal when appropriate. Associated with the temperature sensor 4 is a heat collection fin 10 to reduce the response time of the sensor to changes in ambient air.

The resettable fire detection device 2 includes a molded base 16 having associated therewith an outer shell 18 sealed with the base and which forms a pressure chamber between the interior of the shell and diaphragm 20. The base also includes a calibrated relief vent 22 which allows pressure chamber 28 to adjust at a controlled rate to atmospheric pressure. In the case of a fire, the heat will cause the pressure to increase within pressure chamber 28, resulting in a deformation of the diaphragm 20 if a sufficient pressure differential is established between chamber 28 and the atmosphere. The diaphragm will move and effectively force contact 24 against the stationary contact 26. As can be appreciated, the calibrated relief vent only allows a certain amount of air to bleed to the atmosphere during a certain period of time. In this way, normal changes in the temperature of the air in a room being sensed are accommodated for by the calibrated relief vent, whereas sudden increases in the rate of temperature rise, as experienced during a fire, will result in a pressure buildup within pressure chamber 28, a deformation of diaphragm 20, and a closing of contacts 24 and 26.

Figure 4:
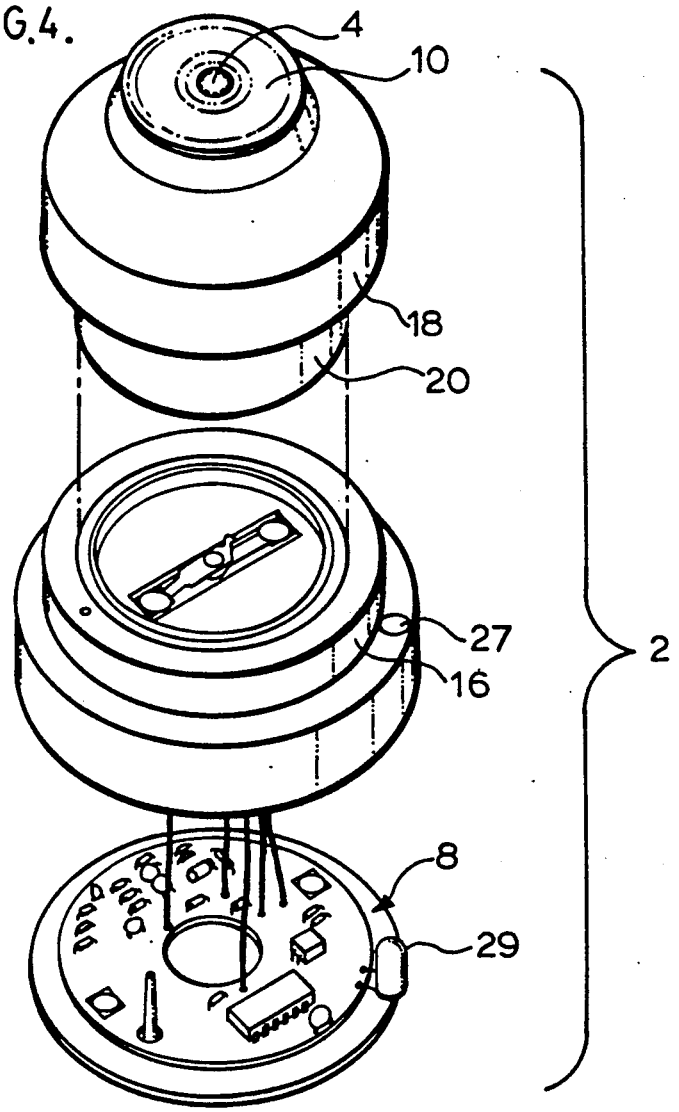
FIG. 4 is a exploded perspective view of the device.
Figure 5:
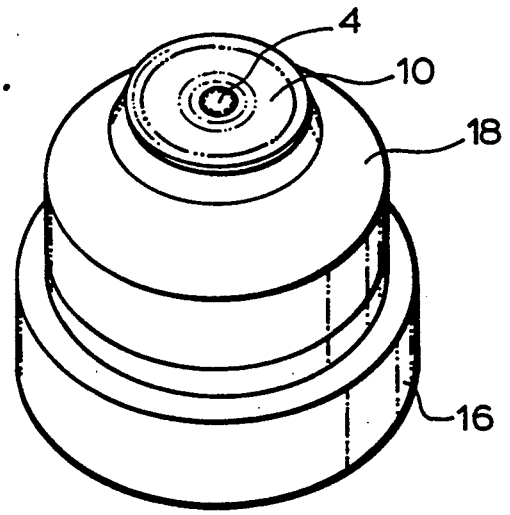
FIG. 5 shows the fire detector in its assembled form.

As seen in FIG. 4, the base 16 includes a port 27 for receiving the light emitting diode 29 attached to the electronic circuitry 8. The LED is on when an alarm condition is sensed and remains on until a reset signal is received.

One problem associated with the mechanical rate of rise sensor is vibration and momentary high shocks, which could inadvertently cause a chattering of the contacts and momentary completion of the circuit. Such false conditions would result in the alarm signal being generated and should be avoided. Most environments in which a smoke detector or fire detector is used are not subject to extensive vibration, however, on occasion, certain occurrences may happen where a momentary force is created which causes the contacts to meet and complete the circuit. To overcome this problem, the electronic circuitry 8 includes a time delay arrangement to reduce these transient type conditions such that if a signal is created as a result of the mechanical rate of rise detector, it is generally a result of a sudden increase in the volume within chamber 28 due to deformation of diaphragm 20.

The fire detector of the present application has application in ships and in particular battleships where rapid sensing of a fire condition may result in lives being saved and possibly even the ship being saved. Many battleships already have smoke detector systems working on a low operating voltage of 16 to 26 volts DC, with each device having an operating current of less than 200 micro-Amps, and in some cases, less than 150 micro-Amps. These smoke detector systems and many fire detection systems have what is referred to as a parallel system and typically have an alarm voltage of 4 to 6½ volts DC.

The use of the electronic integrated circuit for sensing of temperature, namely the temperature sensor 4 in combination with the mechanical rate of temperature rise sensor 6, allows for resetting of the device if either of these sensors is activated. Thus, the system can be completely checked and remotely reset. In addition, the electronic circuitry ensures that the alarm signal remains latched in the event of an alarm condition sensed by either of the sensors and the circuitry allows for convenient changing of the fixed temperature actuation point to be sensed. The circuitry further includes a time delay arrangement to avoid false alarms which are caused by a momentary vibration or high momentary force.

Figure 6:
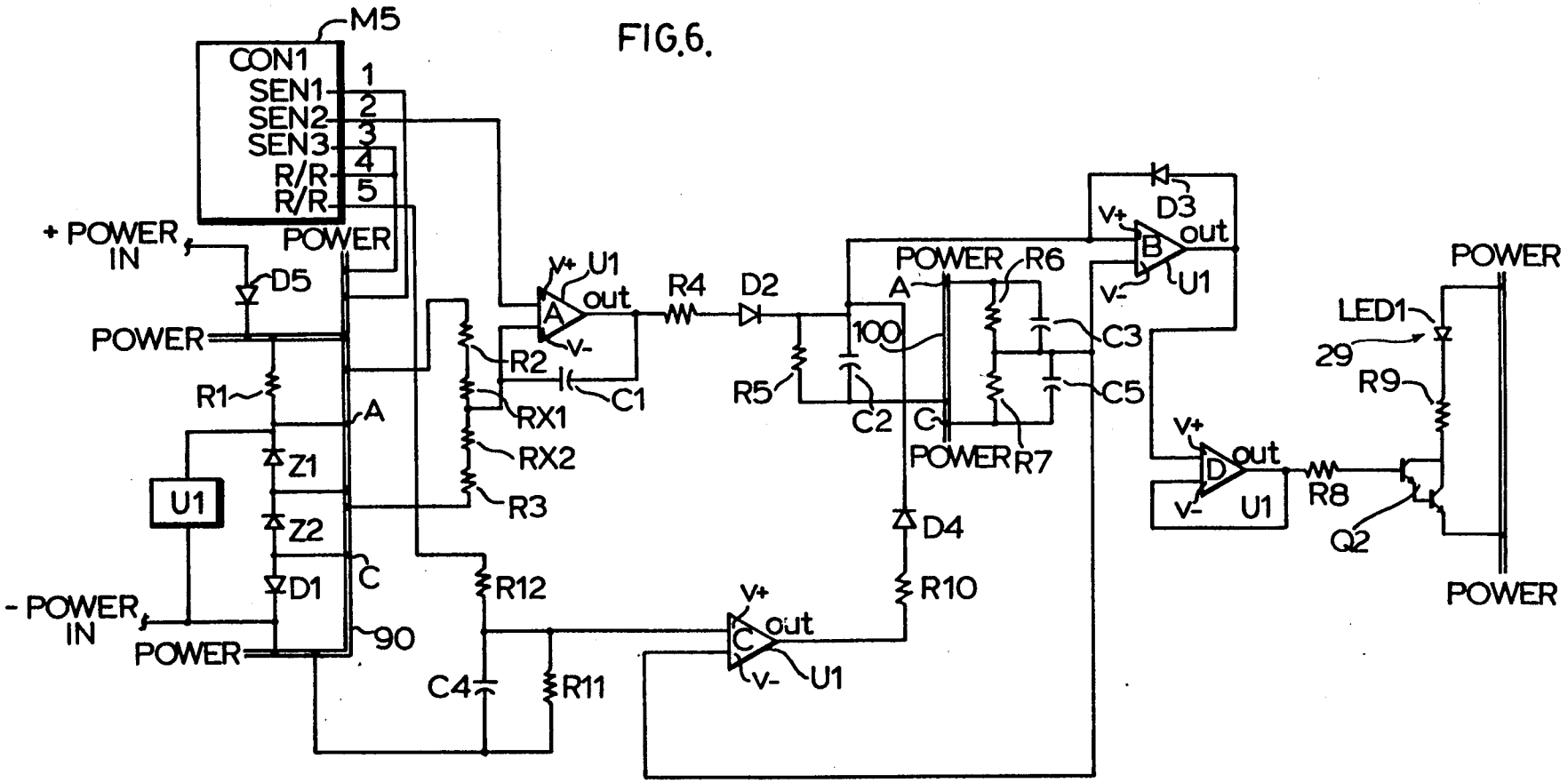
FIG. 6 is a schematic of the electronic circuit used in the device.

The design criteria for the device of the circuitry shown in FIG. 6 is as follows:

| | |
|---|---|
| Operating Voltage: | 16 to 26 volts dc nominal |
| Operating Current: | 150 micro Amp. |
| Alarm Voltage: | 4 to 6.5 volts dc |
| Alarm Current: | See Below** |
| Ambient Temperature: | −25 to 70° C. |
| Storage Temperature: | −40 to 100° C. |
| Relative Humidity: | 0 to 95%, non condensing |
| Reset Time: | 2 seconds, nominal |
| Reset Voltage: | 2 to 4 volts dc |

**The alarm current is dependent of the sense resistor used in the main panel. The amount of current required to drop from the operating voltage (26 vdc) to the alarm voltage (6 vdc) will vary depending on the sense resistor value. This circuit is based on a sense resistor value of 1k ohm. This means that during an alarm the circuit will draw approximately 20 milli-Amp.

This design criteria can change depending upon the application and is provided for a more full understanding of the electronic circuitry.

The electronic circuitry 8 is shown in schematic in FIG. 6. The power supply is composed of power bus 90, diode D1, zener diode Z2, zener diode Z1, resistor R1, and diode D5. A voltage of 16 to 26 volts AC is applied across these series connected components. Each component performs a specific function as follows:

D5—provides reverse polarity protection;

R1—provides current limiting for zener diodes Z1 and Z2;

Z1—provides a stable 5.1 volts DC;

Z2—provides a very stable reference of 1.23 volts DC; and

D1—provides a small negative bias for the IC.

U1 is an ultra-low current quad op-amp. Total current consumption of this IC is under 60 micro-Amps. This selection of the IC is required in designing a unit that will operate under the low current specifications required in allowing substitution of this fire detector with a smoke detector and a smoke detector circuit. Basically, this is necessary for the low current specifications.

Section A of U1 is configured as a comparitor. Its positive input voltage is derived from the solid state temperature IC, generally shown as 4 in FIG. 3. This detector 4 is powered from the previously described power supply. Detector 4 is connected to M5 at pins SEN1, SEN2, and SEN3. Although the voltage across the device can vary with input power fluctuations, the voltage on its output pin 2 of M5, relative to pin 1 of M5, will vary by 10 millivolts per degree celsius. This a direct result of the characteristics of the detector 4. This means that at 40 degrees, the voltage will be $40 \times 0.01 = 0.40$ volts. With this known value being applied to the positive input of U1A, as shown in the schematic, it thus creates a voltage which varies with temperature. The voltage on the negative input can be selected at the factory. This negative voltage is the result of the resistor divider network composed of resistors R2, RX1, RX2, and R3. These series connected resistors are across 21 which is a very stable voltage reference zener diode. By changing the values of RX1 and RX2, a variable voltage of, for example, 0.52 volts can be created relative to pin 1 of M5. This results in the temperature sensor having to provide an output voltage slightly in excess of 0.52 volts DC for U1A's output to go from low to high, signifying an alarm condition. The function of capacitor C1 is to provide negative feedback to overcome problems introduced by noise spikes.

Section C of U1 acts as a detector for the rate of rise sensor, shown as 6 in FIG. 3. One of the contacts associated with the rate of rise detector, namely contact 26, is contacted to pin 5 of M5 and the other contact is connected to pin 4 of M5. Pin 5 of M5 is connected to the resistor network comprising resistors R12 and R11. The summing junction of these two resistors is connected to the positive input of U1C. C4 is used to provide a time delay to the system response to closing contacts 24 and 26 of the rate of rise detector 6. This reduces false alarms due to high vibration or "G" forces that the detector might be exposed to, for example, on a battleship. The negative input of U1C is connected to a voltage derived from resistor network R6 and R7. These resistors are bypassed by C3 and C5 and are connected across zener diodes Z1 and Z2. This is the case, as indicated by the reference points A & C noted on second power bus 100. Reference points A and C are also on power bus 90 and are at the same voltage. The illustration of two power buses is merely for convenience and drawing simplification.

In operation, when the contacts close and remain so for at least 100 milli-seconds (a result of the time delay circuit which defined by R12 and capacitor C4), the voltage on the input of U1C will exceed that on its negative input and cause its output to go from low to high. Closing of contacts 24 and 26 supplies power to R12. This signal is fed through R10 and D4 to the positive input of U1B. Similarly, the signal from U1A is fed through R4 and D2 to this point. The functions of D2 and D4 are to allow U1A and U1C to act independently of each other, and thus, these diodes act as blocking diodes. The resistors are used to provide a divider network with R5. C2 is used to provide increased tolerance to electrical noise.

Section B of U1 is used as a comparitor and latch. The signal on its positive input, as previously described, is a result of an output from either U1A or U1C. The voltage on U1B's negative input is the same as that used on U1C's negative input. When the positive input exceeds its negative as a result of an alarm condition, its output will go high. This high is fed back to its positive input via D3. Because of this, even if the alarm condition disappears, the output of U1B will remain high until the system is reset.

Reset is the result of lowering the power supply voltage below that at which the IC will operate. This is typically a value of less than 4 volts DC and is done by personnel at a control panel.

Section D of U1 is used to buffer the output of U1B and to drive, via R8, the output transistor Q2.

Q2 is a Darlington transistor which when turned on will allow current to flow through R9 and LED1, shown as 29 in FIG. 4. The light emitting diode LED1 provides a visual indication that an alarm condition has been sensed. LED1 is visible at each detector. The alarm signal causes the current consumption of the device to go from less than 150 micro-Amps to approximately 20 milli-Amps. This change in current is used to identity that an alarm has occurred. Further, as a result of this alarm condition, the voltage across the circuit will drop to approximately 6 to 10 volts DC. This value is dependent upon the sense resistor (current limiting) used in the control panel.

The alarm current is dependent upon a sense resistor used in the main control panel. The amount of current required to drop from the operating voltage to the alarm voltage will vary depending upon this particular sense resistor value. The present circuit is based on a sense resistor value of 1K ohm. Under this condition, the alarm circuit will drop approximately 20 milli-Amps.

The present fire detector, due to its low current draw characteristics, can be substituted in existing low draw smoke detecting circuits as manufactured by Cerberus Pyrotronics. In addition, to improving the system by sensing two different conditions as opposed to smoke, the detector has overcome various problems associated with the mechanical rate of rise detector previously used and the mechanical fixed temperature sensor which could not be tested without destroying the same.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A resettable fire detection device comprising in combination a rate of temperature rise sensor, an electronic temperature sensor, and electronic circuitry, said electronic circuitry cooperating with said temperature sensor to define a fixed temperature actuation point, said electronic circuitry being connected to both sensors for producing an alarm signal if either the rate of rise sensor is activated or the fixed temperature actuation point is exceeded and for maintaining said alarm signal once activated until a reset signal is received and wherein said device in use normally has an amperage draw of less than 200 micro-Amps and when actuated, has a large amperage draw, said device being connected between parallel electrical lines, said alarm signal being produced when a substantial drop in voltage occurs caused by said resettable fire detection device detecting a condition actuating said rate of rise sensor or detecting a condition exceeding said fixed temperature actuation point and causing said substantial drop in voltage between the two parallel electrical lines.

2. A resettable fire detection device as claimed in claim 1, wherein said rate of temperature rise sensor is a mechanical arrangement and said circuitry includes means for delaying the alarm signal a period of time, requiring the mechanical arrangement to maintain actuation for said period of time to affect actuation.

3. A resettable fire detection device as claimed in claim 1, wherein said circuitry includes means for varying the temperature actuation point by varying two resistance values in said electronic circuitry.

4. A resettable fire detection device as claimed in claim 3, wherein said electronic circuit includes a common latching arrangement to maintain said alarm signal once either of said sensors has been actuated.

5. A resettable fire detection device as claimed in claim 4, wherein said delay means is an RC circuit.

* * * * *